US010287803B2

(12) United States Patent
Reime

(10) Patent No.: US 10,287,803 B2
(45) Date of Patent: May 14, 2019

(54) KEY, LOCKING SYSTEM, AND METHOD FOR OPENING OR CLOSING THE LOCKING SYSTEM

(71) Applicant: Gerd Reime, Bühl (DE)

(72) Inventor: Gerd Reime, Bühl (DE)

( * ) Notice: Subject to any disclaimer, the term of this patent is extended or adjusted under 35 U.S.C. 154(b) by 0 days.

(21) Appl. No.: 15/521,351

(22) PCT Filed: Oct. 23, 2015

(86) PCT No.: PCT/EP2015/002104
§ 371 (c)(1),
(2) Date: Apr. 24, 2017

(87) PCT Pub. No.: WO2016/062407
PCT Pub. Date: Apr. 28, 2016

(65) Prior Publication Data

US 2017/0314294 A1 Nov. 2, 2017

(30) Foreign Application Priority Data

Oct. 23, 2014 (DE) ..... 10 2014 015 606

(51) Int. Cl.
*E05B 49/00* (2006.01)
*E05B 19/26* (2006.01)
(Continued)

(52) U.S. Cl.
CPC ..... *E05B 49/002* (2013.01); *E05B 19/0047* (2013.01); *E05B 19/26* (2013.01); *G07C 9/00111* (2013.01)

(58) Field of Classification Search
None
See application file for complete search history.

(56) References Cited

U.S. PATENT DOCUMENTS 3,737,685 A 6/1973 Sharp
4,287,733 A * 9/1981 Gomez-Olea ..... G07C 9/00738 70/276
(Continued)

FOREIGN PATENT DOCUMENTS

CN 102037676 A 4/2011
EP 2468987 A2 6/2012

OTHER PUBLICATIONS

International Search Report for corresponding application PCT/EP2015/002104 filed Oct. 23, 2015; dated Jan. 19, 2016.
(Continued)

*Primary Examiner* — K. Wong
(74) *Attorney, Agent, or Firm* — Cantor Colburn LLP

(57) ABSTRACT

The invention relates to a closing system having a key (1.1) coded in a quantum-physical manner, which withstands very high mechanical forces, wear, or temperatures. The key consists, for example, of a solid stainless-steel bar having, for example, a diameter of 8 mm and, for example, a length of 120 mm. The coding of the key (1.1) is based on a quantum-physical solid body cryptography. The matter of the solid main body is partially changed in such a way that this change can be read out by means of read-out methods suitable therefor. The coding occurs into the depth of the main body such that external influences such as damage to the surface do not impair the function of the key. The quantum key processed in such a way has no visible or perceptible features of the coding. More than 500 billion different codings are accommodated on a length of approximately 50 mm. The locking system comprises a decoding unit on the lock for decoding the codings, which have been introduced into the solid metal of the key in a quantum-physical manner. The arrangement according to the invention offers a locking system that is extremely resistant to
(Continued)

forgery and manipulation, on the basis of quantum-physical solid body cryptography.

21 Claims, 3 Drawing Sheets

(51) Int. Cl.
*E05B 19/00* (2006.01)
*G07C 9/00* (2006.01)

(56) References Cited

U.S. PATENT DOCUMENTS 4,331,013 A * 5/1982 Jaulmes ..... G07C 9/0073 335/206
4,380,162 A * 4/1983 Woolfson ..... E05B 47/0044 70/276
4,416,127 A * 11/1983 Gomez-Olea Naveda ..... G07C 9/0073 70/276
4,712,398 A * 12/1987 Clarkson ..... E05B 47/063 361/172
4,748,834 A * 6/1988 Herriott ..... E05B 47/0038 335/306
4,788,623 A * 11/1988 Haug ..... G07C 9/0073 335/206
4,990,906 A * 2/1991 Kell ..... B60R 25/04 340/5.23
5,085,062 A * 2/1992 Capdevila ..... G07C 9/00738 70/276
5,268,560 A * 12/1993 Ueda ..... G07C 9/00944 235/375
6,705,139 B2 * 3/2004 Tsai ..... E05B 47/0044 70/276
9,542,785 B2 * 1/2017 Meganck ..... G07C 9/00309
2007/0126551 A1 6/2007 Slevin
2007/0146117 A1 6/2007 Slevin
2011/0096955 A1 4/2011 Voloshynovskiy et al.

OTHER PUBLICATIONS

Chinese Office Action for the Chinese Application No. 201580061072X; Chinese Filing Date: Oct, 23, 2015; dated Sep. 21, 2018; 12 pages.

* cited by examiner

KEY, LOCKING SYSTEM, AND METHOD FOR OPENING OR CLOSING THE LOCKING SYSTEM

CROSS REFERENCE TO RELATED APPLICATIONS

The present invention relates to and claims the priority of German patent application 10 2014 015 606.0, filed on 23 Oct. 2014, the disclosure of which is hereby expressly incorporated by reference into the subject matter of the present application in its entirety.

TECHNICAL FIELD

The invention relates to a key for a locking system and a method for opening or closing the locking system.

BACKGROUND

Locking systems protect objects or information from unauthorised access. A mechanical or electronic lock having a corresponding mechanical or electronic key moves or controls for example a bolt system for locking a door. However, no lock or locking system is absolutely secure. With enough time, criminal energy and technical expenditure, most locks can be "cracked". Keys are secretly copied, methods for opening without a key are devised, electronic systems are collected by espionage and defeated. For this reason, over time the technologies of locks and locking systems have been repeatedly further developed in order to make criminal access correspondingly more difficult.

Various types of locks or locking systems exist. In the case of a purely mechanical lock, mechanical unlocking for example of a door is achieved by means of a mechanical key. The force for moving the bolt results from the movement of the mechanical key, for example a rotary movement, once the shape of the key in the lock has been checked and corresponding mechanical features match the lock specification and permit the rotary movement. This shape of the lock, for example as a cylinder lock, is widespread.

In the case of an electrical locking system, an electrical or hydraulic operation moves the bolts. The key that fits the lock merely triggers this operation. This may be done by a simple motor control or by appropriate data items, for example to a central location. Frequent applications include so-called transponder locks, in which an electronic key exchanges data with a corresponding electronic lock.

A: mechanical lock

Typically, a mechanical key carries mechanical features that are externally visible and that are correspondingly checked in the lock. If the key and the lock match, locking is permitted, with the result that turning the key can trigger a further mechanical operation.

Advantage of Mechanical Locks:

They are relatively simple to manufacture, and keys may be passed to other persons without problems. Usually, the keys are made of metal and also withstand high temperatures, for example in the event of a fire.

The disadvantage of locks of this kind consists in so-called lock picking, that is to say opening a mechanical lock using corresponding methods and tools. The fact that there are even official championships for this demonstrates the insecurity of locks of this kind. Moreover, mechanical keys are typically easy to copy, since the key's mechanical "information" is openly shown.

A further type of lock is the combination lock, in which entering an appropriate number triggers an opening mechanism.

Disadvantage: passing on the combination "key" is problematic, since the person receiving it may have to note a relatively long sequence of numbers.

Numbers may be forgotten, in particular when there is time pressure.

B: electronic lock:

The key of an electronic lock comprises electronic components that exchange information by radio or optical link when a magnetic card or the key is brought close to the lock, or in the event of manual activation. If access is authorised, a corresponding opening mechanism is then actuated electrically, for example by way of a servo motor.

Advantage of Electronic Lock:

Data may be managed in central processors, for example ideally as a time-recording system. (Electronic) lock picking is difficult or impossible.

Disadvantage of electronic keys: mechanically sensitive, and can easily become faulty. Can be spied on. Does not withstand high temperatures; in the event of a fire an electronic key is typically irreparably destroyed.

The more difficult it is to pick a lock or to copy a key, the more reliable the locking system. In the case of the cylinder locks which are usual today, a key may be reworked within a few minutes without any problems at all by any specialist locksmith or suitable service provider such as are to be found today in many shopping centres. Even high-security keys only provide "higher" levels of security to the extent that they are not (legally) permitted to be reworked by key service providers because of corresponding regulations. From a technical point of view, copying a key of this kind is hardly ever a problem. There is thus only security against forgery because of corresponding agreements. Nowadays, even a photo of a key taken from some distance away is sufficient to make a complete functional copy of the key using a 3D printer.

BRIEF SUMMARY

Taking this prior art as a starting point, the disclosure provides a key, a locking system and a locking method that are not copiable, or only with the appropriate expertise and considerable technical expenditure, and cannot be actuated by any other desired method without the key that fits.

The invention describes a locking system that comprises a forgery-proof key and a corresponding electronic reader unit. On the key itself, neither the code of the key nor the change that has been made to the microstructure of its metal are detectable, visible or perceptible by touch by people without further aids. The quantum-physically encoded key looks for example simply like a solid metal bar which may be of any desired shape. The code takes place deep into the base body, with the result that external influences such as damage to the surface do not impair the function of the key. Similarly, these quantum-physical changes to the metal microstructure of the solid metal body of the key are scannable without mechanical interaction. The quantum key that is prepared in this way has no features of the code that are visible to the naked eye or perceptible by touch, and may take any desired shape. A length of approximately 70 mm accommodates more than 500 billion different codes.

Thus the key used in the locking system resists very strong mechanical forces, very high wear or very high temperatures. Encoding of the key is based on quantum-physical solid body cryptography. In so doing, the material of the solid base body is partially changed such that this change can be read out by means of suitable reading methods.

Moreover, external coatings using anodisation, polishing, staining or indeed sanding and sand blasting have no effect on the function. It is also possible to incorporate key labelling, promotional material, etc. into the surface by way of deep stamping.

The locking system contains a decoding unit for decoding the codes that have been quantum-physically incorporated into the solid metal of the key. In this way, the arrangement provides a locking system that is forgery-proof and tamper-proof to the very highest level, based on quantum-physical solid body cryptography.

Further advantages are apparent from the subclaims and the description given below of an exemplary embodiment.

BRIEF DESCRIPTION OF THE FIGURES

The invention is explained in more detail below with reference to an exemplary embodiment that is illustrated in the attached Figures, in which.

DETAILED DESCRIPTION

Figure 1:
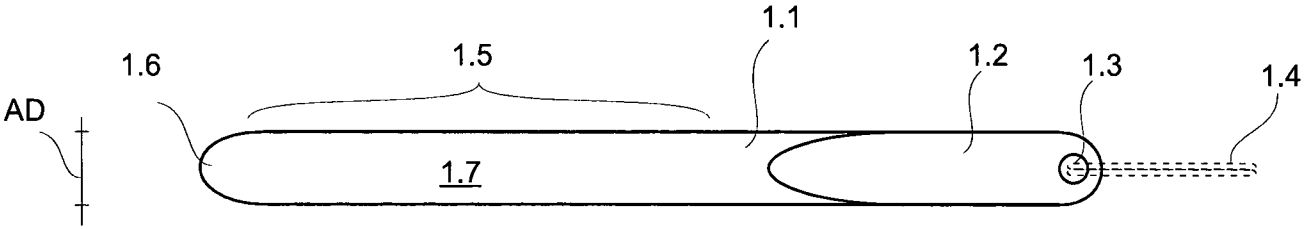
FIG. 1 shows a key according to the invention in side view.

The invention is now explained in more detail by way of example, with reference to the attached drawings. However, the exemplary embodiments are only examples, which are not intended to restrict the inventive concept to a particular arrangement. Before the invention is described in detail it should be pointed out that it is not restricted to the respective constituent parts of the device and the respective method steps, since these constituent parts and methods may vary. The terms used here are merely intended to describe particular embodiments and are not used restrictively. Moreover, where the singular or the indefinite article is used in the description or the claims, this also refers to a plurality of these elements unless the overall context unambiguously indicates otherwise.

Within the context of this invention, the term "lock" is not used for the mechanical locking device but, strictly speaking, for a reader unit that is able to read a code on a key and then, if the code that is read matches the code stored for the lock, such as a numerical sequence, to release the mechanical locking device. In this context, for example the locking channel 2.8 is also actually a reader channel.

In the invention described here, a key 1.1 is used, comprising a solid, preferably monolithic, metal part with no structures that are visible or perceptible by touch in any way. In the exemplary embodiment, the key comprises a short stainless-steel bar having for example a length of 120 mm and a diameter of 8 mm. The end of this stainless-steel bar is shaped appropriately for better manageability, and is provided with a hole 1.3 for the conventional key ring 1.4. The end that is inserted into the keyhole is rounded.

The lock in the exemplary embodiment comprises a round or square stainless-steel cylinder, with a cover plate at one end and electrical terminals at the other end. The "keyhole" is a round opening in the cover plate. Located in the interior of the cylinder are the electronics, which scan the key 1.1 by way of corresponding sensors and read the code. The key itself is guided in a tube that has an internal diameter only a little larger than the 8 mm of the key, in the exemplary embodiment a Teflon tube having an internal diameter of for example 8.5 mm. The key is guided freely in the tube and does not make contact, mechanically or electrically, at any point. Seen from this point of view, the keyhole 2.5 is hermetically sealed from the detection system, that is to say for example that no gas or similar can be introduced into the locking system.

For unlocking or locking, the key is simply introduced into the keyhole 2.5, in any desired position, as far as it will go. Once the corresponding code of the key has been read, an opening or closing operation can be triggered electrically. However, the key may also be turned—in the manner of its mechanical counterpart—for example anticlockwise or clockwise, in order only then to initiate unlocking, or clockwise or anticlockwise, in order to trigger a closing operation.

The key is encoded by making a quantum-technical change to the material of the key body, deep in the key body. The cryptographic information of the key number is encoded in these changes.

In the exemplary embodiment of the key body that is 70 mm long and has a diameter of 8 mm according to FIG. 1, more than 500 billion different codes may be accommodated. For the sake of simplicity, the key is designated a "quantum key" in the description below. The quantum-technical change in the base material requires the appropriate expertise and devices, with the result that it is almost impossible simply to "copy" a key of this kind. This quantum-technical change in the structure of the key body is not visible. This means that an impression cannot be taken of a key manufactured in this way (photo, wax impression or similar). Mechanical changes for example by filing or sawing at the surface, hammering, heating, cooling, etc. have no effect on the function. Nor is any damage caused by bending the key, provided that it is bent back again such that it fits into the locking channel. According to FIGS. 1, 2, the key may for example have the appearance of a simple round bar.

Moreover, external coatings using anodisation, polishing, staining or indeed sanding and sand blasting have no effect on the function. It is also possible to incorporate key labelling, promotional material, etc. into the surface by way of deep stamping.

In the exemplary embodiment of FIG. 1, the quantum key 1.1 comprises a solid stainless-steel bar having a diameter of 8 mm and an overall length of 120 mm. The rounded shape 1.6 at the front end serves to make it easier to introduce the key into the keyhole 2.5. The symmetrical recess or milled area 1.2 is not needed for technical reasons but, in the exemplary embodiment, serves merely for better handling of the key. The hole 1.3 may receive a conventional key ring 1.4, such that the quantum key may easily be attached to conventional bunches of keys.

Located in the code region 1.5 is the quantum-technical code of the key, which is invisible even to an attentive observer. Over a length of for example 70 mm, quantum-technical codes are incorporated such that more than 500 billion different cryptographic options can be used.

Figure 3:
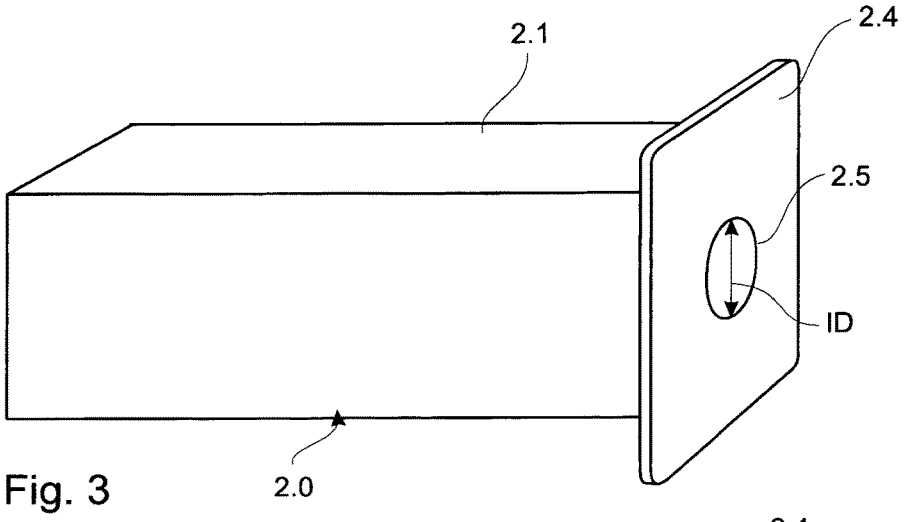
FIG. 3 shows a three-dimensional view of a housing for a lock.
Figure 4:
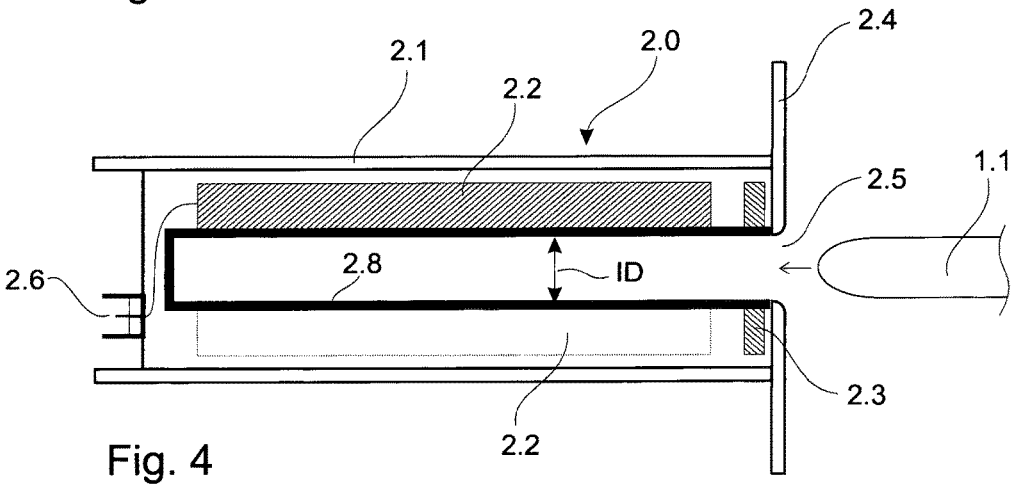
FIG. 4 shows a section through the housing in FIG. 3.

According to FIG. 3, the actual "lock" 2.0, called a "quantum lock" for the sake of simplicity, is accommodated in the exemplary embodiment in a square housing 2.1 made from stainless steel and contains the mechanical guide 2.8 for the key 1.1, a key detector 2.3, and the reader unit 2.2 for the quantum-technical code. The front termination of the lock is formed by a front plate 2.4 that is fixedly connected to the square cylinder. Located in the front plate is the circular keyhole 2.5. According to FIG. 4, the mechanical guide 2.8 of the key 1.1 comprises a tubular part, for example made from ceramic or Teflon. The end of this part is hermetically sealed. This is necessary for example for applications in which an absolutely tight seal, for example gas-tight or pressure-tight, is required. Moreover, the depth of insertion of the key is limited thereby. The elements for fixing the quantum lock in a wall or door have not been illustrated, since general fixing techniques are familiar to those skilled in the art.

Located close to the keyhole 2.5 is a sensor 2.3 for detecting a key. This sensor 2.3 detects the fact that the key has been inserted, and activates the sensor unit 2.2 for reading the quantum-physical code of the key. In the exemplary embodiment, the sensor 2.3 consumes an extremely small amount of current from the supply voltage 3.4. In this way, the system is perfectly able to operate for a very long time independently, powered by battery. Once the insertion of a key has been detected, the reader unit 2.2 for reading the quantum-technical code is activated. Admittedly, reading the code consumes more energy, but this is only for a few milliseconds for each opening and closing operation. As a result, the average energy consumption remains very low, with the result that operation using battery power can be guaranteed for a period of years. Naturally, the sensor 2.3 can also be dispensed with if sufficient energy is permanently available.

All the keys that are manufactured carry an absolutely unique number between one and 500 billion. The corresponding key number is allocated to the evaluation electronics 3.1 in the lock by means of programming, with the result that only this or further programmed numbers can open the lock. If for example a central locking facility is used, it is possible for further numerical combinations also to be associated with a corresponding key and passed on by way of the interface 3.2, for example to a central processor. In the case of an individual locking facility, the electronics of the interface 3.2 may of course also actuate an opening mechanism directly, for example by means of servo motor.

In the exemplary embodiment, after insertion of the key—which may incidentally be introduced into the keyhole in any desired position—and after identification of the correct opening authorisation, further turning of the key is detected. Thus, for example, once the key has been inserted and the key has then been turned anticlockwise or clockwise, an opening mechanism may open for example of a door. Similarly, turning clockwise or anticlockwise would lock the door again. In this way, the same intuitive function as in the case of a mechanical lock is achieved, but without any mechanical function being performed.

Figure 5:
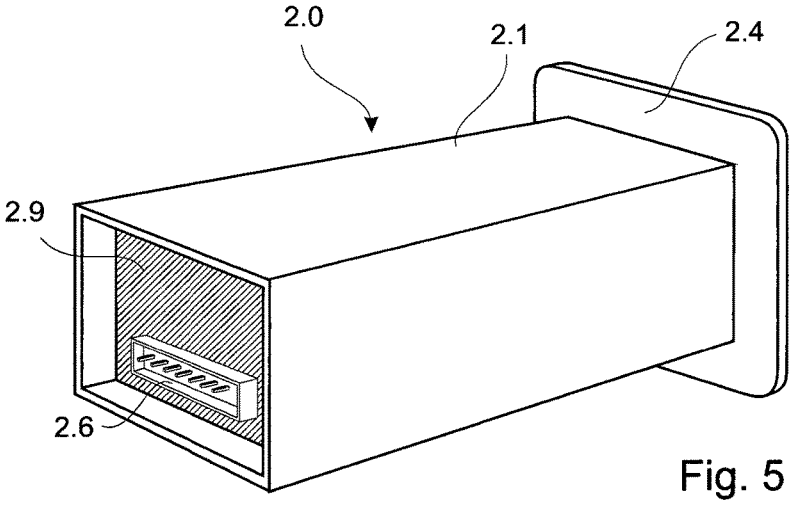
FIG. 5 shows a view of the housing from obliquely behind it, and FIG. 6 a diagrammatic illustration of the underlying electrical mode of operation.

In the exemplary embodiment according to FIG. 5, the electronics required for the function of the quantum key are encapsulated in potting compound 2.9. In the rear part of the quantum lock there is located, in the exemplary embodiment, a socket having the terminal contacts 2.6. The regions around the terminal socket may also be metal-shielded accordingly. Because this means that the entire lock is entirely encapsulated in metal, with the exception of the keyhole 2.5 and the terminal contacts 2.6, a very high resistance to EMC interference is achieved.

Figure 6:
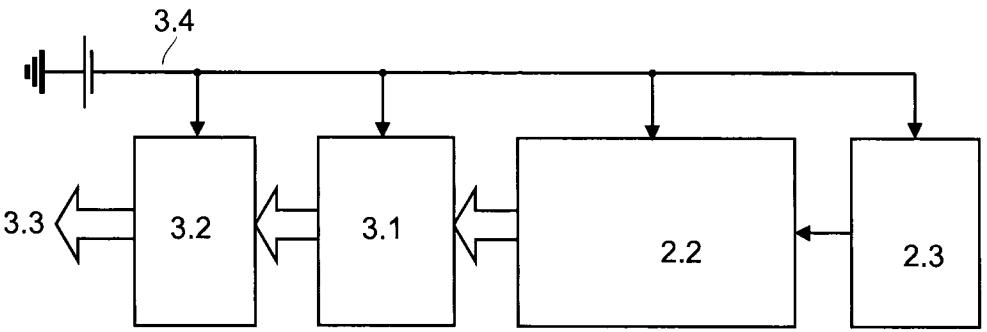

FIG. 6 shows the underlying electrical mode of operation of the exemplary embodiment. Once the quantum key has been introduced into the keyhole, the sensor 2.3 for key detection activates the reader unit 2.2 for reading the quantum-technical code of the key 1.1. Detection of whether a key has been introduced is contactless. The reader unit 2.2 for reading the quantum-technical code also operates in contactless manner, through the mechanical guidance provided by the locking channel 2.8 or reader channel of the key. The key number is compared with the number stored in the evaluation electronics 3.1, and if there is a match a further corresponding data word 3.3 is passed by way of the interface 3.2, for example to a central processor. In the case of an individual locking facility, the interface 3.2 may of course also directly control for example a servo motor in the locking mechanism. The supply voltage 3.4 may for example be drawn from a lithium battery.

In the absence of the quantum key, with a supply voltage of 3 V the sensor 2.3 for key detection consumes only a current of 1.5 μA. Once the quantum key has been introduced, the sensor 2.3 activates the reader unit 2.2 for reading the quantum code of the key 1.1, the evaluation electronics 3.1 and the interface 3.2. The time needed for evaluation by the reader unit 2.2 is correspondingly short, as is the time needed for evaluation of the correct key number and data transmission, with the result that the average current consumption with approximately 100 closing and opening operations per day is under 10 μA.

The quantum key 1.1 may of course also take any other desired shape, for example that of a flat disc. The essential point is that the reader unit 2.2 for reading the quantum code can detect the code appropriately.

The key 1.1 for the locking system 2.0 is formed by a metal body that has along its length and/or its periphery a code region 1.5 for a code 3.3 for opening or closing a lock. The code 3.3 is formed by quantum-physical changes to the metal microstructure of the metal body, and these are not perceptible to people without further aids, in particular being neither visible nor perceptible by touch. The metal body of the key 1.1 may take any desired shape. For example, the metal body of the key may be in the shape of a bar, preferably a round bar, which preferably has a constant diameter along the code region 1.5.

The code 3.3 is formed in the code region 1.5 by making quantum-physical changes to the metal microstructure of the solid metal body of the key 1.1 wherein these changes are scannable without mechanical interaction. Here, the invention makes use of the realisation that such quantum-technical changes to the metal microstructure result in a change in the energy exchange, in particular with an alternating magnetic field. This change may be measured by evaluating the hysteresis losses, that is to say that the quantum-physical changes are scannable electromagnetically, for example. At the same time, however, these changes are not perceptible by people without further aids or with the naked eye, in particular being neither visible nor perceptible by touch. Externally, the key has rather the appearance for example of a round bar or similar. The quantum-physical changes are within the mesoscopic range. In solid state physics, a transitional range lying between the microscopic and the macroscopic is called mesoscopic. Put simply, the mesoscopic range extends on a length scale from about a nanometre to about a micron. A multiplicity of these changes made to the metal microstructure then together represent a code within a code zone 1.8. If a plurality of items of information are incorporated next to one another in a code zone along the periphery of the key 1.1, this applies to every individual item of information. This means that each partial item of information of the code comprises a multiplicity of mesoscopic changes that are not perceptible externally. Typically, these changes are from 0.1 to 2 mm in length or in diameter.

As well as the key 1.1, the locking system includes a lock having a locking channel 2.8 for introduction of the key 1.1. Associated with the locking channel 2.8 is a decoding unit for decoding the code 3.3 of the key 1.1. The shape of the reader unit 2.2 of the decoding unit is adapted to the shape of the metal body. The metal body of the key 1.1 is for example formed by a round bar having an external diameter AD that is slightly smaller than the internal diameter ID of the locking channel 2.8. The reader unit 2.2 is arranged on the locking channel 2.8 and is hermetically separated from the locking channel 2.8. Here, it is also possible for a plurality of reader devices for each individual code zone 1.8 to be provided, arranged serially one behind the other, but typically one reader unit is arranged at the periphery of the locking channel 2.8, preferably in a plane transverse to the longitudinal direction of the locking channel, and this reads, one after the other, the items of information that are encoded in the individual code zones 1.8 when the key 1.1 is introduced into the locking channel 2.8.

Figure 2:
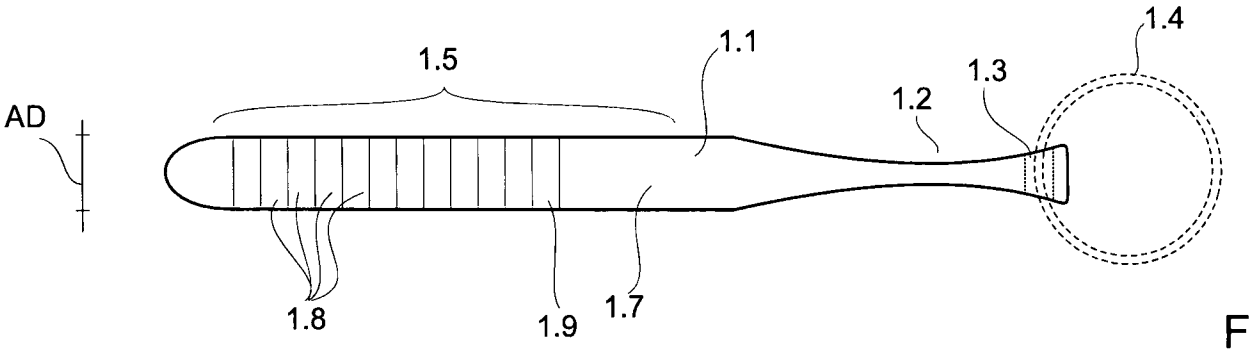
FIG. 2 shows the key according to the invention from FIG. 1, in a further side view, wherein the code is indicated.

According to FIG. 2, the code region 1.5 preferably has a plurality of code zones 1.8 that may also each be individually encoded differently and multiple times along the periphery. At the end of the code region 1.5 that is at a spacing from the rounded shape 1.6 by which the key first enters the locking channel 2.8, at least one further zone, such as an end zone 1.9, is provided. This end zone 1.9 allows a decoding unit to detect whether the key is completely inserted. This can be achieved in that, in the event of only partial introduction, a symmetrical code is read which does not actually exist, since the decoding unit could read a code both during the introduction movement and also on withdrawal.

During opening or closing, the key 1.1 is introduced into the elongate locking channel 2.8. It has along its length and/or its periphery the code 3.3 for opening or closing the lock, which is encoded by making a quantum-physical change to the metal microstructure of the solid metal body. The key 1.1 is introduced into the locking channel 2.8 in any desired position, and once the code 3.3 of the key 1.1 has been correctly identified, turning the key 1.1 about its longitudinal axis brings about opening or closing of the lock.

It goes without saying that this description may be subject to the broadest possible variety of modifications, changes and adaptations which are within the range of equivalents to the attached claims.

The invention claimed is:

1. A key for a locking system, comprising:

a metal body that has along at least one of its length or its periphery a code region for a code for opening or closing a lock, wherein the code is formed by quantum-physical solid body cryptography on a metal microstructure of the single monolithic solid metal body of the key, and wherein the code is scannable without mechanical interaction and is not perceptible to people.

2. A key according to claim 1, wherein the quantum-physical changes are scannable electromagnetically.

3. A key according to claim 1, wherein the quantum-physical changes to the metal microstructure are mesoscopic, wherein a mesoscopic range extends on a length scale from about a nanometer to about a micron.

4. A key according to claim 1, wherein the quantum-physical changes are neither visible nor perceptible by touch.

5. A key according to claim 1, wherein the metal body of the key takes any desired shape.

6. A key according to claim 1, wherein the metal body of the key is in the shape of a bar or a round bar.

7. A key according to claim 6, wherein the round bar has a constant diameter along the code region.

8. A key according to claim 1, wherein the surface of the metal body takes the form of a carrier of promotional material.

9. A key according to claim 1, wherein the surface of the metal body that is used as advertising media is printed, anodised or provided with a deep stamping.

10. A locking system, comprising:

a key; and a locking channel for introducing the key;

wherein the key is formed by a metal body that has along at least one of its length or its periphery a code region for a code for opening or closing a lock, wherein the code is formed by quantum-physical solid body cryptography on a metal microstructure of the single monolithic solid metal body of the key, wherein the code is scannable without mechanical interaction with the locking channel and is not perceptible to people, being neither visible nor perceptible by touch, and wherein associated with the locking channel is a decoding unit for decoding the code of the key.

11. A locking system according to claim 10, wherein the quantum-physical changes are scannable electromagnetically, and in that the decoding unit is an electromagnetically operating decoding unit.

12. A locking system according to claim 10, wherein the quantum-physical changes to the metal microstructure are mesoscopic, wherein a mesoscopic range extends on a length scale from about a nanometer to about a micron.

13. A locking system according to claim 10, wherein the quantum-physical changes are neither visible nor perceptible by touch.

14. A locking system according claim 10, wherein the shape of a reader unit of the decoding unit is adapted to the shape of the metal body.

15. A locking system according to claim 10, wherein the decoding unit has a reader unit that is arranged on the elongate locking channel and is hermetically separated from the locking channel.

16. A locking system according to claim 10, wherein the metal body of the key is formed by a round bar having an external diameter that is slightly smaller than the internal diameter of the locking channel.

17. A locking system according to claim 10, wherein a sensor unit that is upstream of the decoding unit as the key is introduced into the locking channel is provided for the purpose of detecting whether a key is introduced.

18. A method for opening or closing a locking system that has a key and an elongate locking channel for introducing the key, wherein the key is formed by a metal body that is encoded along at least one of its length or its periphery with a code for opening or closing a lock, and wherein the locking channel is adapted to the shape of the key, which is shaped in any desired way, wherein the key is encoded by quantum-physical solid body cryptography on a metal microstructure of the single monolithic solid metal body of the key, wherein the code is scannable without mechanical interaction with the locking channel and is not perceptible to people, wherein the key is introduced into the locking channel in any desired position, and wherein, once the code of the key has been correctly identified, turning the key about its longitudinal axis effects opening or closing of the lock.

19. A method according to claim 18, wherein the quantum-physical changes are neither visible nor perceptible by touch.

20. A method according to claim 18, wherein the quantum-physical mesoscopic changes to the metal microstructure are scanned by a decoding unit by means of electromagnetic fields that are generated by the decoding unit.

21. A method according to claim 18, wherein introducing the key into the locking channel is detected by a sensor unit and activates a reader unit of a decoding unit.

* * * * *